US007516856B2

(12) United States Patent
Lee et al.

(10) Patent No.: US 7,516,856 B2
(45) Date of Patent: Apr. 14, 2009

(54) SPACE ADJUSTABLE RACK FOR COCKTAIL GLASSES TO ENDURE EARTHQUAKE

(76) Inventors: David Y. Lee, 2803 S. Santa Fe Ave., Vernon, CA (US) 90058; Younki Kho, 2803 S. Santa Fe Ave., Vernon, CA (US) 90058

( * ) Notice: Subject to any disclaimer, the term of this patent is extended or adjusted under 35 U.S.C. 154(b) by 53 days.

(21) Appl. No.: 11/274,591

(22) Filed: Nov. 16, 2005

(65) Prior Publication Data

US 2007/0108149 A1 May 17, 2007

(51) Int. Cl.
*A47F 5/00* (2006.01)
*A47B 43/00* (2006.01)

(52) U.S. Cl. ..... 211/189; 211/184

(58) Field of Classification Search ..... 211/184, 211/189, 187, 186, 134, 126.2, 133.1, 126.1, 211/126.4; 108/60, 61; 206/561; 220/500, 220/529

See application file for complete search history.

(56) References Cited

U.S. PATENT DOCUMENTS 4,811,670 A * 3/1989 Kolvites et al. ..... 108/107
5,279,231 A * 1/1994 Kolvites et al. ..... 108/107
5,384,103 A * 1/1995 Miller ..... 422/310
5,423,251 A * 6/1995 Kolvites et al. ..... 100/110
5,709,158 A * 1/1998 Wareheim ..... 108/186
5,884,782 A * 3/1999 Dembicks ..... 211/70.6
6,116,436 A * 9/2000 Ferrucci et al. ..... 211/187
6,244,447 B1 * 6/2001 Frieze et al. ..... 211/85.13
6,290,077 B2 * 9/2001 Sosso ..... 211/189
6,378,764 B1 * 4/2002 Teixidor Casanovas ..... 229/191
7,066,342 B2 * 6/2006 Baechle et al. ..... 211/191
7,137,517 B2 * 11/2006 Lowry et al. ..... 211/188
2007/0034584 A1 * 2/2007 Park ..... 211/187

* cited by examiner

*Primary Examiner*—Jennifer E. Novosad
(74) *Attorney, Agent, or Firm*—Peter Gandian

(57) ABSTRACT

A space adjustable rack for storing fragile wine/Champaign/cocktail glasses during transportation and for storing the glasses in house is provided. The space adjustable precious alcohol beverage glass storing rack can hold glasses of different sizes at the same time. The rack of the current application is comprised of a bottom structure, pluralities of latitudinal spacing blades, and pluralities of longitudinal spacing blades. The space adjustable rack protects those wine/Champaign/cocktail glasses from severe vibration impact caused by earthquake and transportation.

2 Claims, 5 Drawing Sheets

SPACE ADJUSTABLE RACK FOR COCKTAIL GLASSES TO ENDURE EARTHQUAKE

FIELD OF THE INVENTION

Current application is related generally to a field of multi-size glass organizer, particularly to a space adjustable glass organizer endurable to vibrations caused by earthquake and moving for transportation.

BACKGROUND OF THE INVENTION

Most of glasses for drinking beverages, especially wine glasses, Champaign glasses, and cocktail are manufactured in a beautiful shape and various sizes. Therefore, endurance to impact is not significantly considered. However, some of them are very expensive for the name value of the designer. Conventional method of packaging such expensive but very fragile glasses for transportation is to pack them between plastic-packing materials such as puffs of polyester foams. Meanwhile, means for storing those fragile glasses in house is very limited. Most popular mean is a rack to hang the glasses up side down between two long thin rods. Structures of existing wine glass racks known to these days are not stable enough to protect the wine glasses hang on there when vibration impact caused by earth quake or similar movement of the rack itself. It is the purpose of the current application to provide a rack that can protect the fragile contents from breaking due to severe vibration impact caused by earthquake and/or by sudden stop of a transportation means.

DESCRIPTION OF PRIOR ART

U.S. Pat. No. 6,745,906 to Nagel illustrates an adjustable width product display system, which is comprised of a wire rack for supporting display products.

U.S. Pat. No. 5,572,924 to Crnjanski illustrates a roasting rack having an infinitely adjustable width comprising two interlocking frameworks.

U.S. Pat. No. 6,851,563 to Lipari illustrates a rack having bottle supports and dividers for supporting the bottles in the staggered array.

U.S. Pat. Nos. 6,843,381 and 6,357,607 to Wu a multifunction rack for wine glasses composed of a pair of shelf supports, a tubular frame and a glass board, to be installed to supporting walls in a liquor cabinet.

U.S. Pat. No. 5,711,436 to Moeller, et al. illustrates a combination drinking glass and wine glass rack.

U.S. Pat. No. 4,991,723 to Elkins illustrates a gun mount including two-spaced adjustable gun racks, and each of the gun racks are arranged to be held in position by the frame of a rear window of a pickup truck so that a plurality of guns can be supported at spaced intervals thereon and safely transported in a pick-up truck.

U.S. Pat. No. 4,700,849 to Wagner illustrates a combination wine rack and glass retention/dispensing assembly for glasses of a type having a stem attached to a generally planar base.

None of the prior art illustrates a noble method of holding wine glasses of various sizes in a rack safe from shake caused by an earthquake.

SUMMARY OF THE INVENTION

A size adjustable rack for storing fragile wine/Champaign/cocktail glasses during transportation and for storing the glasses in house is provided. The size adjustable wine/Champaign/cocktail glass storing rack can hold glasses of different sizes at the same time. The rack of the current application is comprised of a bottom structure, pluralities of latitudinal spacing blades, and pluralities of longitudinal spacing blades. The bottom structure has a shape of square box having opening to the topside and to the front side. Pluralities of square slits are developed on the bottom and three sidewalls. Four corners of the bottom structure have triangular pipe structure for receiving triangular prisms, which are used to stack the racks vertically. The longitudinal spacing blades have same overall shape of long thin square plate. Pluralities of vertical grooves for receiving latitudinal spacing blades are developed on the longitudinal spacing blades. Pluralities of protrusions for engaging the longitudinal spacing blades into the square slits developed on the bottom surface of the bottom structure are developed on the narrow bottom side of the longitudinal spacing blades. The latitudinal spacing blades have various horizontal lengths. But, the height of the longitudinal spacing blades is same. By adjusting the distances between longitudinal spacing blades and latitudinal spacing blades, wine/Champaign/cocktail glasses of different sizes are stored in the rack of the current application. Due to the noble structure, the glasses are protected from severe vibration impact caused by earthquake.

DETAILED DESCRIPTION OF THE PREFERRED EMBODIMENT

Figure 1:
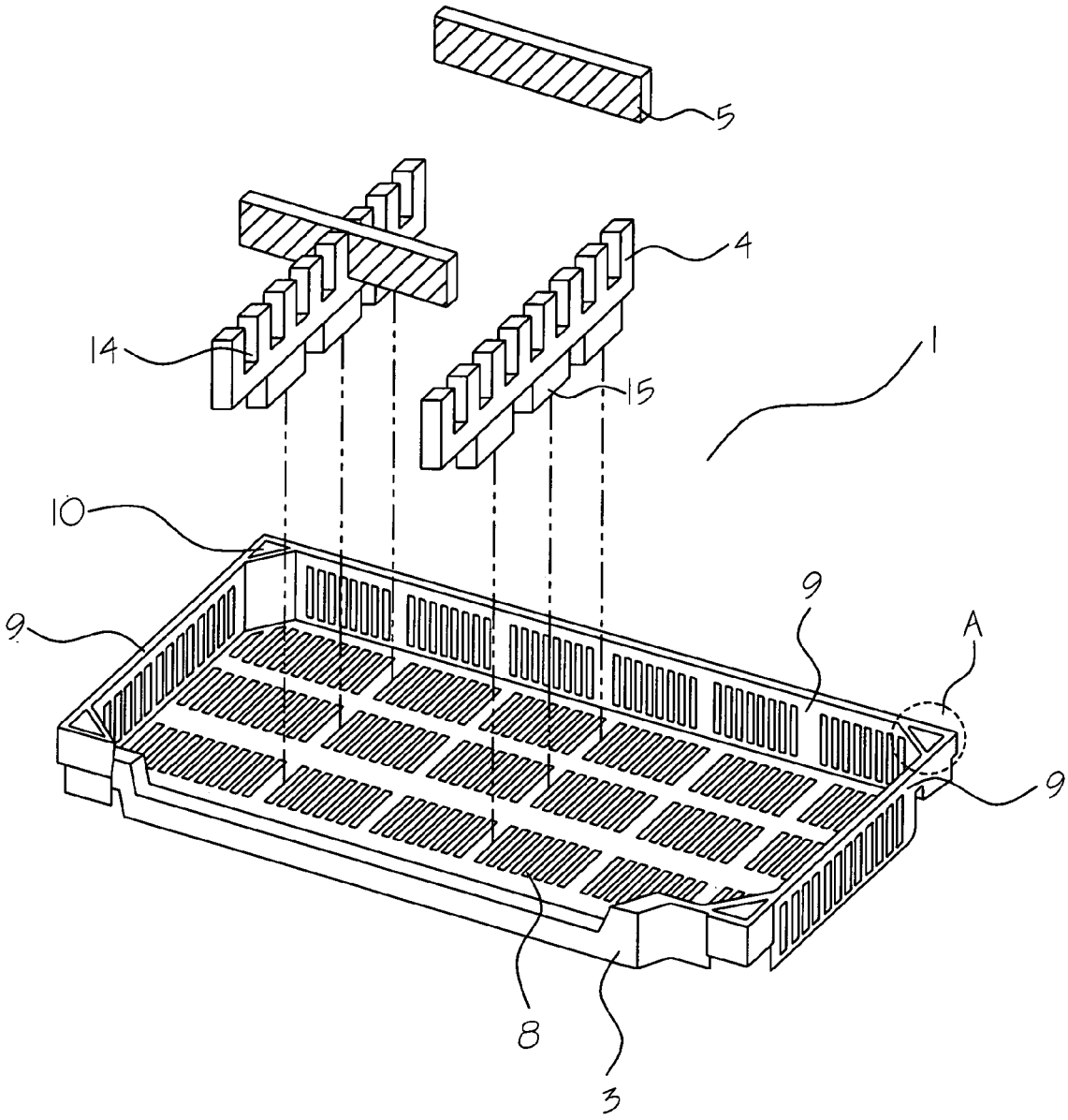
FIG. 1 is an exploded perspective view of one tray of size adjustable wine/Champaign/cocktail glass rack of the current application.

FIG. 1 is an exploded perspective view of one tray (1) of size adjustable wine/Champaign/cocktail glass holding rack (2) of the current application. One size adjustable wine/Champaign/cocktail glass-storing tray (1) of the rack can hold glasses of different sizes at the same time. One tray (1) of the current application is comprised of a bottom structure (3), pluralities of longitudinal spacing blades (4), and pluralities of latitudinal spacing blades (5). The bottom structure (1) has a shape of square box having opening to the top side and to the front side. Pluralities of square slits (8) are developed on the bottom and three side walls (9).

Figure 2:
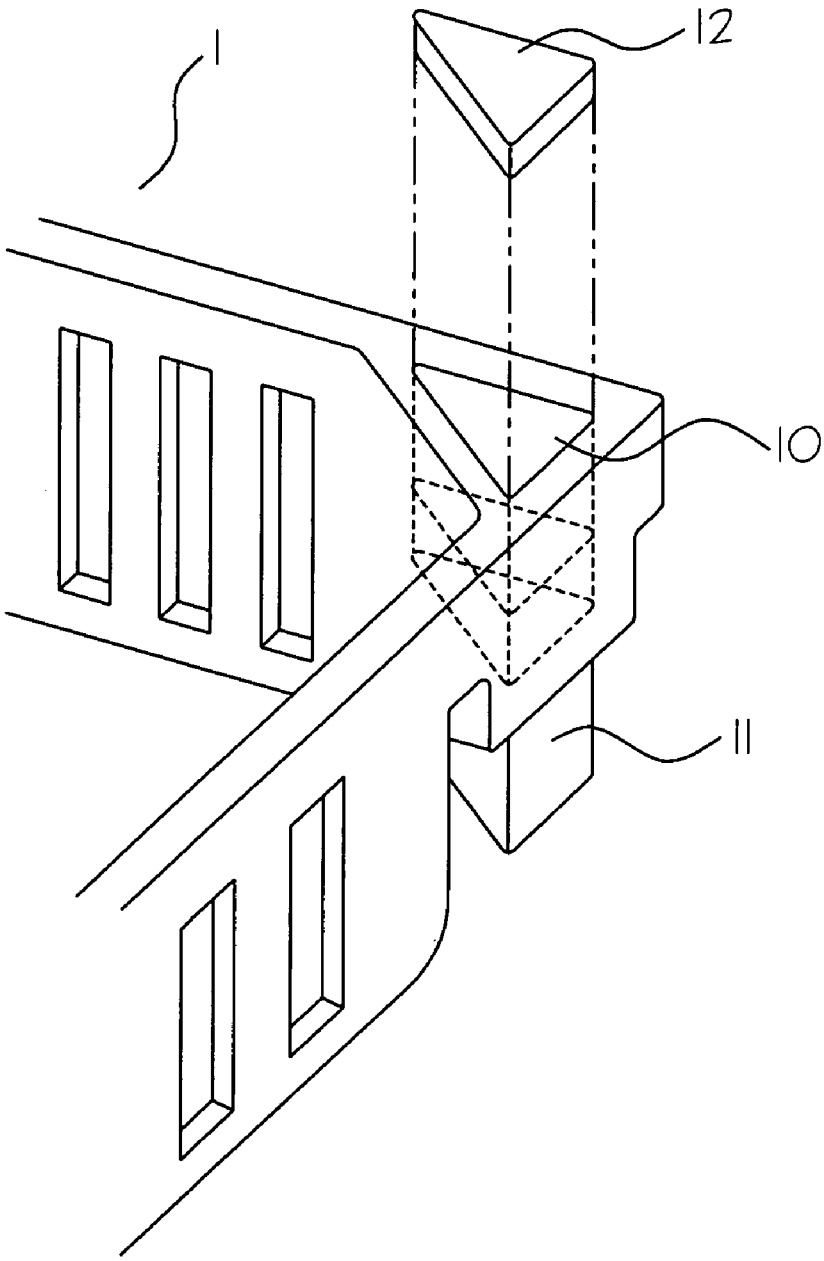
FIG. 2 is an enlarged view of the triangular pipe structure; section 'A' in FIG. 1.

FIG. 2 is an enlarged view of the triangular pipe structure (10); section 'A' in FIG. 1. Four corners of the bottom structure (3) have triangular pipe structure (10) for receiving triangular prisms (11), which are used to stack the trays (1) vertically. For the tray (1) placed on the top, four tri angular stoppers (12) are used to cover the upper end opening of the triangular pipe structure (10).

Figure 3:
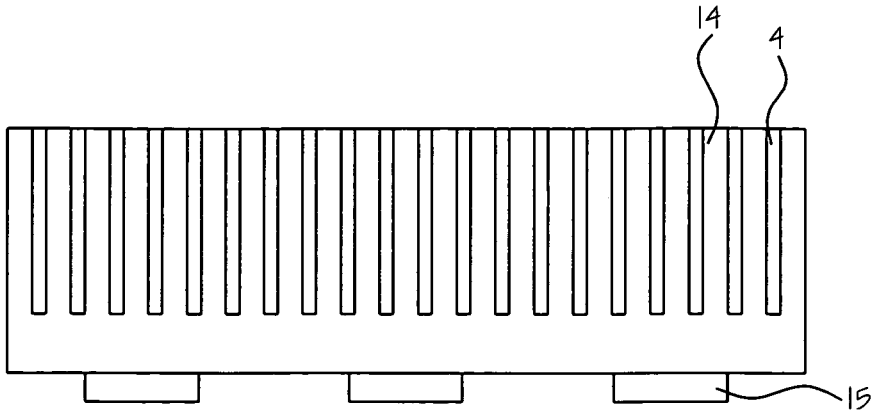
FIG. 3 is a front view of a longitudinal spacing blade of the current application.
Figure 4:
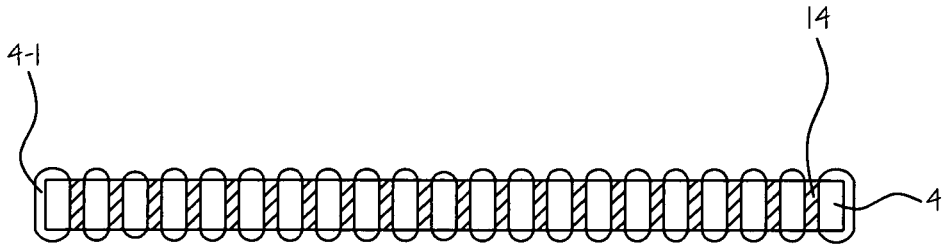
FIG. 4 is a top view of the longitudinal spacing blade of the current application.

FIG. 3 is a front view of a longitudinal spacing blade (4) of the current application. The longitudinal spacing blades (4) have same overall shape of long thin square plate. FIG. 4 is a top view of the longitudinal spacing blade (4) of the current application. Pluralities of vertical grooves (14) for receiving latitudinal spacing blades (5) are developed on both sides the broad surface of the longitudinal spacing blades (4). Surface of the longitudinal spacing blades are coated with soft elastic material (4-1) such as silicon, polyurethane, and soft PVC (poly-vinyl chloride) to reinforce the protection ability of the tray (1). Number of grooves (14) and space between the grooves are adjusted per requirement. Width of the grooves is same as the width of the latitudinal spacing blades (5). Pluralities of protrusions (15) for engaging the longitudinal spacing blades (4) into the square slits (8) developed on the bottom surface of the bottom structure (3) are developed on the narrow bottom side of the longitudinal spacing blades (4).

Figure 5:
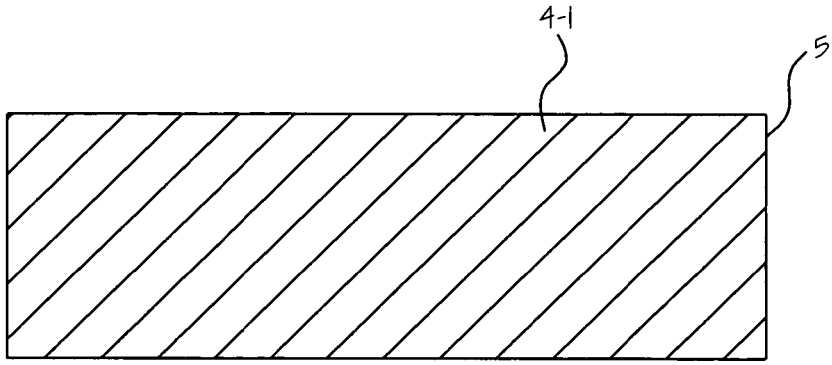
FIG. 5 is a front view of a latitudinal spacing blade of the current application.

FIG. 5 is a front view of a latitudinal spacing blade (5) of the current application. The latitudinal spacing blades (5) have various lengths (16). But, the height (17) of all the latitudinal spacing blades (5) is the same. Surface of the latitudinal spacing blades (5) are coated with soft elastic material (4-1) such as silicon, polyurethane, and soft PVC (poly-vinyl chloride) to reinforce the protection ability of the tray (1).

Figure 6:
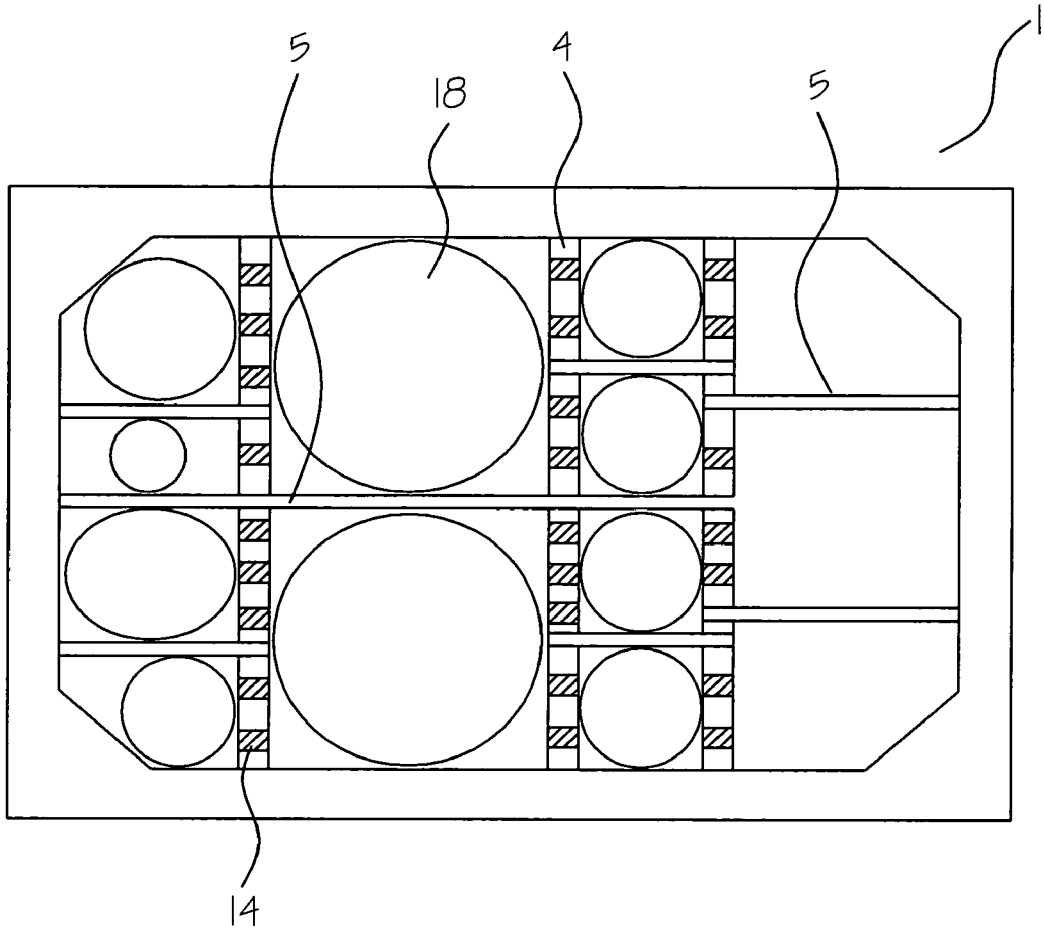
FIG. 6 is an over view of the size adjustable wine/Champaign/cocktail glass tray of the rack of the current application showing glasses of different sizes are stored in one tray.

FIG. 6 is an over view of the size adjustable wine/Champaign/cocktail glass tray (1) of the rack (2) of the current application showing glasses (18) of different sizes are stored in one tray. By adjusting the distances between longitudinal spacing blades (4) and latitudinal spacing blades (5), wine/Champaign/cocktail glasses of different sizes are stored in one tray (1) of the rack (2) of the current application. Due to the narrow clearance between the glasses and spacing blades (4) and (5), the glasses (18) are protected from severe vibration impact caused by earthquake.

Figure 7:
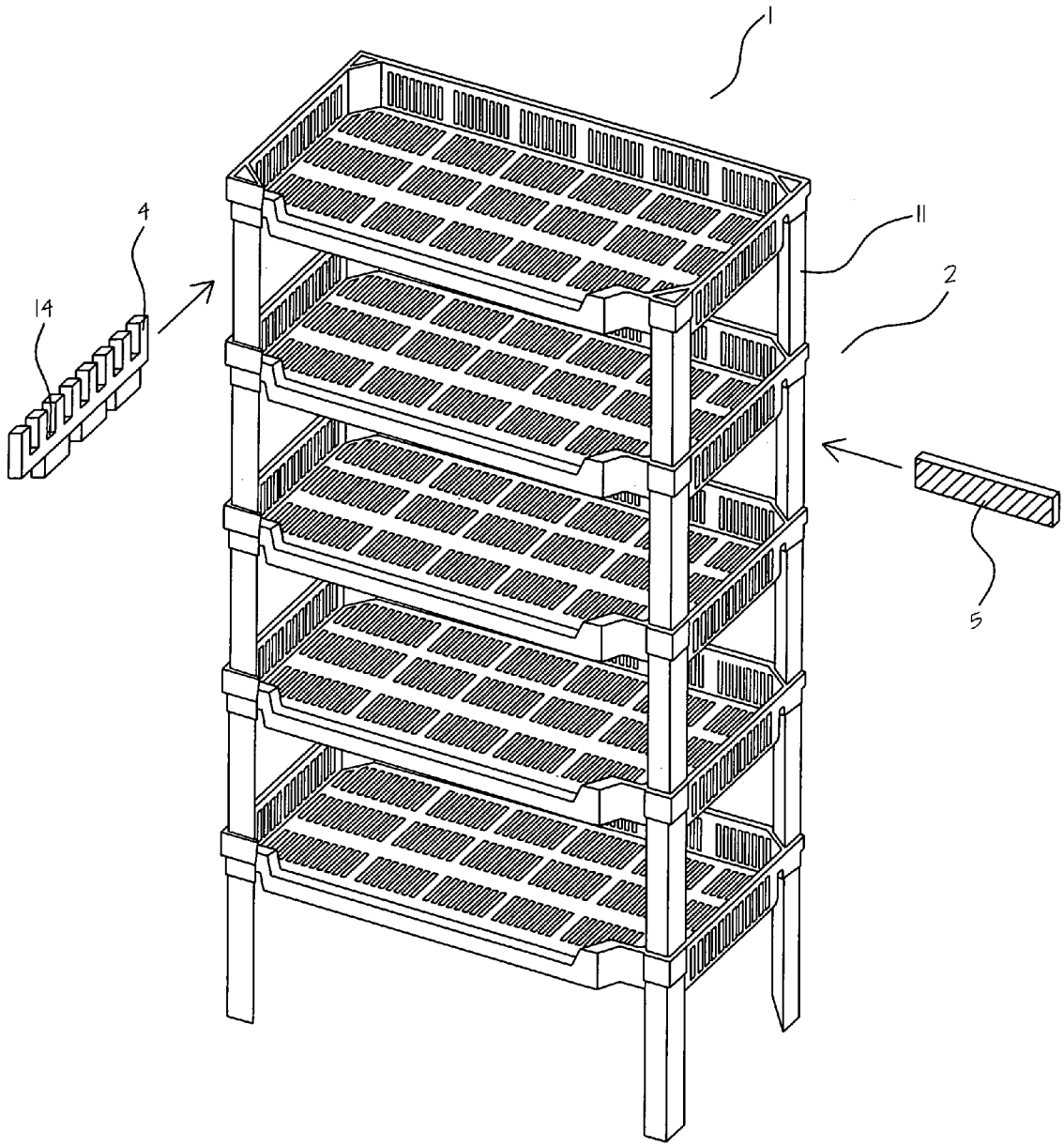
FIG. 7 is a perspective view of the size adjustable wine/Champaign/cocktail glass rack of the current application stacked vertically.

FIG. 7 is a perspective view of the size adjustable wine/Champaign/cocktail glass rack (2) of the current application formed by stacking trays (1) vertically. The four corner triangular pipe structure (10) are covered with four triangular stoppers (12).

What is claimed is:

1. A space adjustable multi size wine/Champaign/cocktail glass holding rack comprised of:

a plurality of trays, with a tray of the plurality of trays comprising:

a bottom with a set of slits;

a first lateral wall and a second lateral wall;

the first lateral wall and the second lateral wall are protruded from the bottom, and are oriented parallel along a width of the tray;

a third side wall protruded from the bottom, and oriented parallel along a length of the tray, forming a back wall;

a first lateral wall end of the first lateral wall and a first back end of the back wall are integral, forming a first corner having triangular prism open structure;

a second lateral wall end of the second lateral wall and a second back end of the back wall are integral, forming a second corner having triangular prism open structure;

a front side wall protruded from the bottom, and oriented parallel along the length of the tray, forming a front wall;

the front wall having a first height along distal ends thereof that is substantially equal to a height of the first and second lateral walls and the back wall, and having a second height along a middle section that is substantially less than the height of the first and second lateral walls and the back wall;

the distal ends of the front wall extend outward and away from the first and second lateral walls, and then slant from the first height towards the second height, forming a rim along a length of the middle section of the front wall, which facilitates placement and removal of items;

the front wall is integral with the first lateral wall at a first distal end, forming a third corner having triangular prism open structure, the front wall is further integral with the second lateral wall at a second distal end, forming a fourth corner having triangular prism open structure;

the triangular prism open structure has an exterior facing height that is less than an integral structures of first and second lateral walls, the back wall and the front wall, and an interior facing height that is substantially equal to the height of the integral structures of first and second lateral walls, the back wall and the front wall;

the triangular prism open structure is configured to accommodate a commensurately shaped pipe structure that form four legs of the rack, which enable vertical stacking of a plurality of horizontally oriented trays; and plurality of latitudinal spacing blades;

plurality of longitudinal spacing blades having plurality of vertical grooves that receive the latitudinal spacing blades, and include plurality of protrusions that engage into the set of slits.

2. A space adjustable multi size wine/Champaign/cocktail glass holding rack of claim 1, wherein: the commensurately shaped pipe structure has an open top that is covered with a cap.

* * * * *